US009248548B2

(12) United States Patent
Tatematsu et al.

(10) Patent No.: US 9,248,548 B2
(45) Date of Patent: Feb. 2, 2016

(54) DRUM FOR A SHOT BLASTING APPARATUS AND SHOT BLASTING APPARATUS

(75) Inventors: Ryo Tatematsu, Toyokawa (JP); Mitsuo Ishikawa, Toyokawa (JP); Tsunetoshi Suzuki, Toyokawa (JP)

(73) Assignee: I. SINTOKOGIO, LTD., Nagoya-Shi (JP)

( * ) Notice: Subject to any disclaimer, the term of this patent is extended or adjusted under 35 U.S.C. 154(b) by 0 days.

(21) Appl. No.: 13/704,799

(22) PCT Filed: Oct. 14, 2010

(86) PCT No.: PCT/JP2010/068052

§ 371 (c)(1), (2), (4) Date: Dec. 17, 2012

(87) PCT Pub. No.: WO2011/161841

PCT Pub. Date: Dec. 29, 2011

(65) Prior Publication Data

US 2013/0090044 A1 Apr. 11, 2013

(30) Foreign Application Priority Data

Jun. 21, 2010 (JP) ..... 2010-140938

(51) Int. Cl.
*B24C 3/30* (2006.01)
*B24C 9/00* (2006.01)

(52) U.S. Cl.
CPC .... *B24C 3/30* (2013.01); *B24C 9/00* (2013.01)

(58) Field of Classification Search
CPC ..... B24C 3/26; B24C 3/30; B24C 9/00; B24B 31/02; B24B 31/023
USPC ..... 451/85, 86, 30, 326, 328
See application file for complete search history.

(56) References Cited

U.S. PATENT DOCUMENTS 2,210,584 A * 8/1940 Hileman et al. ..... 451/328
2,254,219 A * 9/1941 Hamren ..... 451/3

(Continued)

FOREIGN PATENT DOCUMENTS

CN 2635284 8/2004
GB 649837 A * 2/1951 ..... B24B 31/023

(Continued)

OTHER PUBLICATIONS

International Search Report dated Jan. 18, 2011; PCT JP2010/068052; two pages.

(Continued)

*Primary Examiner* — Monica Carter
*Assistant Examiner* — Marcel Dion
(74) *Attorney, Agent, or Firm* — Farabow, Garrett & Finnegan, Henderson, Dunner, L.L.P.

(57) ABSTRACT

The present invention provides a drum for a shot blasting apparatus that uniformly treats the works to be treated by increasing the level of agitation of the works that are buried at the bottom of the drum, and, further, suppressing the traces of collisions on the works, which traces are caused by the works colliding with each other. The drum comprises a hollow middle part, a lower-half part having the shape of a truncated cone, having a closed bottom, and having a projecting part for agitating that is connected to both the lower-half part and the middle part, and that agitates the works, wherein the projecting part for agitating has at least two surfaces, one being the surface for picking-up the works and the other being the surface for having the works slide down. The present invention also provides the shot blasting apparatus using the drum.

11 Claims, 19 Drawing Sheets

(56) References Cited

U.S. PATENT DOCUMENTS

| | | | | | |
|---|---|---|---|---|---|
| 2,351,453 | A | * | 6/1944 | Pearl | 451/85 |
| 2,424,955 | A | * | 7/1947 | Potter | 451/86 |
| 2,440,819 | A | * | 5/1948 | Evans | 451/3 |
| 2,539,973 | A | * | 1/1951 | Ransohoff | 451/328 |
| 2,592,054 | A | * | 4/1952 | Mertz et al. | 144/208.9 |
| 4,003,164 | A | * | 1/1977 | Carpenter et al. | 451/85 |
| 4,254,592 | A | * | 3/1981 | Berna et al. | 451/86 |
| 4,866,889 | A | * | 9/1989 | Goldmann | 451/89 |
| 6,431,955 | B1 | * | 8/2002 | Toschi | 451/32 |

FOREIGN PATENT DOCUMENTS

| | | | | | |
|---|---|---|---|---|---|
| GB | 838048 | A | * | 6/1960 | B24B 31/023 |
| JP | 52-122989 | | | 10/1977 | |
| JP | 56-152581 | | | 11/1981 | |
| JP | 60-113864 | | | 8/1985 | |
| JP | 60-113864 | U | * | 8/1985 | B24C 3/26 |
| JP | 62-188355 | | | 11/1987 | |
| JP | 08-126959 | | | 5/1996 | |
| JP | 08126959 | A | * | 5/1996 | |
| JP | 2002-210656 | | * | 7/2002 | B24C 3/26 |
| TW | M270875 | | | 7/2005 | |

OTHER PUBLICATIONS

Supplementary European Search Report for EP Application No. 10853701.0 dated Mar. 13, 2015.

* cited by examiner (a)

(b)

(c)

DRUM FOR A SHOT BLASTING APPARATUS AND SHOT BLASTING APPARATUS

TECHNICAL BACKGROUND

The present invention relates to a shot blasting apparatus that carries out treatment of works to be treated by injecting particles for treatment (shots) in a drum of the shot blasting apparatus wherein the shot blasting apparatus, while rotating a drum in which the works to be treated (work) are supplied, carries out descaling, trimming, etc., of small articles and thin parts.

Particularly, it relates to a drum for the shot blasting apparatus that has a high agitating capability so that it can treat uniformly the works to be treated. Also, it relates to a shot blasting apparatus using the drum.

BACKGROUND

Conventionally a shot blasting apparatus having a cabinet, a rotating drum having holes, and a centrifugal injecting device, is publicly known (see Patent Document 1). The cabinet comprises a cover that can close an opening for supplying the works to be treated and for discharging the works that were treated. The drum can turn on an axis for turning, which axis is horizontal, and perpendicularly goes through the axis for rotation of the drum. The drum can turn around within the cabinet and can stop at positions for supplying the works to be treated, for treating the works to be treated, and for discharging the works that were treated.

Further, the drum has a cylindrical shape or a shape of a hollow polygonal pillar and has a closed bottom. At the inner surface of the drum plate-like-bar projections are provided in a spiral fashion whereby the works to be treated are agitated as the drum rotates.

But for this kind of drum for the shot blasting apparatus, there were the following problems. Namely, while the works to be treated that were positioned at the part nearer to the opening of the drum 1 and the part that is at the center 2 of the drum were highly and effectively agitated, the works to be treated that were at the bottom 3 of the drum were least agitated such that they were not efficiently exposed to the treatment by the particles for treatment (shots). As a result, as a whole the works that were treated were not uniformly treated (see FIG. 1).

Patent Document 1: Laid-open Japanese patent application, Publication No. H08-126959

SUMMARY OF THE INVENTION

In view of these problems, the drum for a shot blasting apparatus and the shot blasting apparatus of the present invention have been developed. It is the object of the present invention to provide a drum for the shot blasting apparatus wherein the drum carries out a treatment of the works to be treated by the particles for treatment (shots) being injected and wherein the shot blasting apparatus, while rotating the drum, in which the works to he treated (work) are supplied, carries out descaling, trimming, etc., of the small articles and thin parts.

The drum can, as a whole, uniformly treat the works to be treated by increasing the level of agitation of the works to be treated that are buried at the bottom of the drum and, further, suppress the traces of collisions on the works that were treated, which traces are caused by the works colliding with each other.

Also, the present invention provides a shot blasting apparatus that comprises the drum.

The drum for the shot blasting apparatus of the present invention carries out the treatment of the works to be treated by injecting the particles for treatment into the drum, while the drum, into which. the works to be treated are supplied, rotates. The drum comprises a hollow middle part, a lower-half part having a shape of a cone, a circular truncated cone, or a U-shape, and having a closed bottom, a convex part that is connected to the lower-half part and whose height is less than that of the lower-half part, and a projecting part for agitating that is connected to both the lower-half part and the middle part, and that agitates the works to be treated.

Also, the projecting part for agitating of the drum for the shot blasting apparatus of the present invention has at least two surfaces, one being the surface for picking-up the works to be treated and the other being the surface for having the works slide down.

The drum for the shot blasting apparatus of the present invention can increase the capacity for agitating the works to be treated that are buried at the bottom part of the drum by providing the projecting part for agitating that has the surface for picking up. By providing the surface for having the works slide down, it can prevent the works to be treated from being damaged by the traces of collisions, which traces would otherwise be caused by the works to be treated colliding with each other.

The shot blasting apparatus of the present invention comprises, in addition to the drum for the shot blasting apparatus, a cabinet and a centrifugal injecting device wherein the drum can turn around the axis for turning of the drum, which axis runs horizontally and goes through the axis for rotation of the drum, wherein the drum turns around within the cabinet and can stop at the positions for supplying the works to be treated, for treating the works to be treated, and for discharging the works that were treated. Also, the cabinet comprises the cover that can close an opening for supplying the works to be treated and for discharging the works that were treated. Further, the cabinet comprises a sealing-wall member consisting of a ceiling-wall, a floor-wall, and both side walls, on the side of the opening of the cabinet. The cover is attached to the drum and they can turn around as one body.

The shot blasting apparatus of the present invention can carry out uniform treatment of the works to be treated by injecting the particles for treatment.

Below, one embodiment of the present invention is explained based on the drawings.

Figure 3:
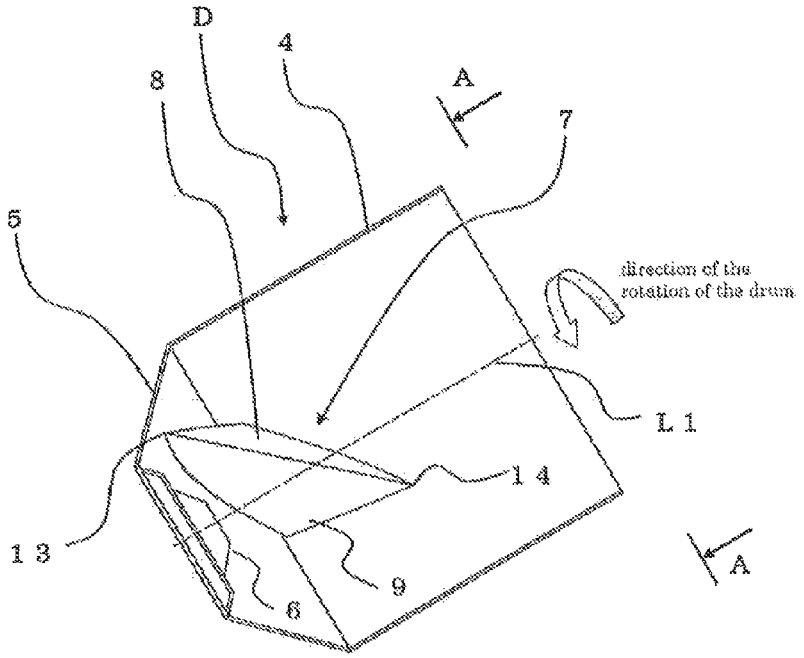
FIG. 3 is a cross-sectional drawing of the drum for the shot blasting apparatus in one embodiment of the present invention, with a part of the shot blasting apparatus omitted.

The present invention provides a shot blasting apparatus that carries out treatment of works to be treated by particles for treatment (shots) being injected in a drum D of the shot blasting apparatus wherein the shot blasting apparatus, while rotating the drum around the axis for rotation L1 of the drum, in which the works to be treated (work) are supplied, carries out descaling, trimming, etc., of the small articles and thin parts. As shown in FIG. 3, the drum D comprises a middle part 4 of a cylindrical shape, a lower-half part 5 having a shape of a truncated cone and having a closed bottom, a convex part of a circular truncated cone 6, whose height is less than that of the lower-half part 5, and a projecting part for agitating 7.

The projecting part for agitating 7 is formed to have a shape that has a surface for picking up 8 and a surface for having the works slide down 9, such that the projecting part for agitating 7 can agitate, by the rotation of the drum D, the works to be treated W and move them in the direction of the rotation of the drum and also in. the direction from the lower-half part 5 of the circular truncated cone to the part nearer to the opening 1.

Figure 5:
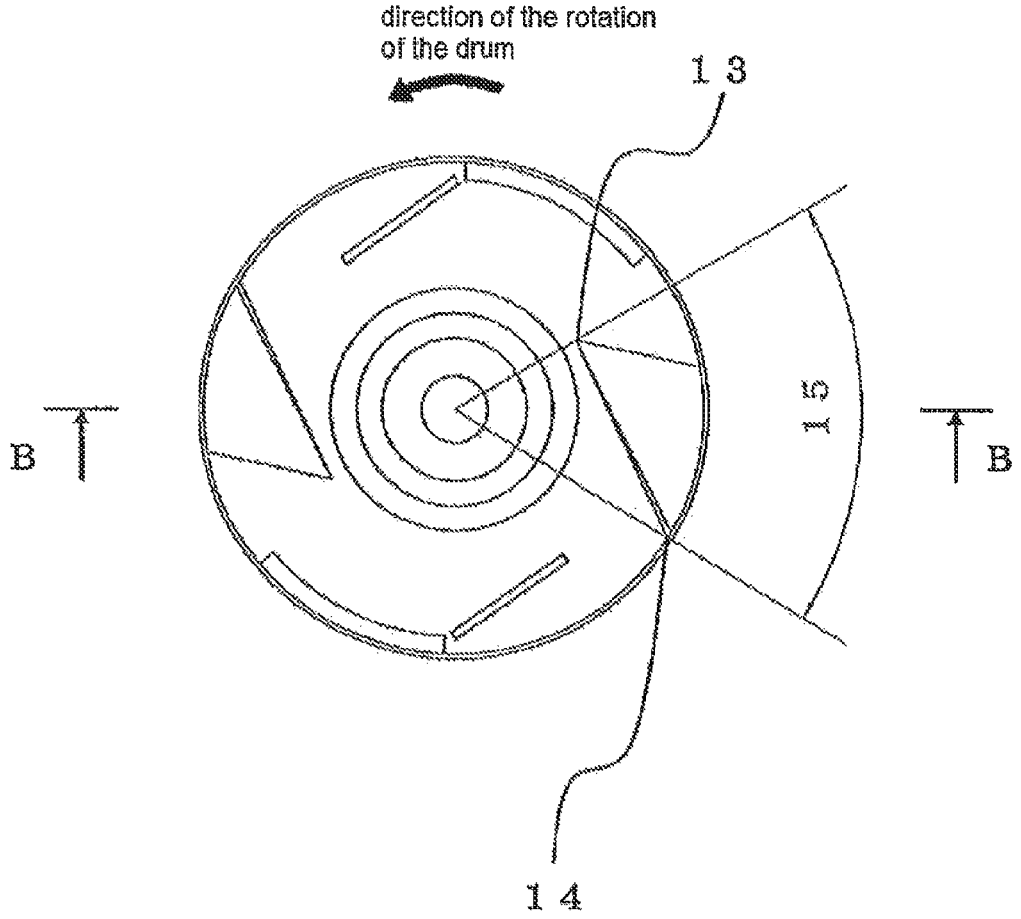
FIG. 5 is a view as seen from the direction A in FIG. 3 (a part omitted).

The surface for picking up 8 scoops up the works to be treated W that are buried at the lower part of the drum and, by the rotation of the drum, pushes them down toward the opening of the drum along the surface for picking up (see FIG. 2), because the surface for picking up 8 has an angle of twist 15 (see FIG. 5).

When the works to be treated are moved horizontally and agitated by the rotation of the drum D, the surface for having the works slide down 9, by having the works to be treated pushed down along the surface for having the works slide down 9, operates so as to reduce the number of works that have the traces of collision that are caused by the works to be treated W colliding with each other.

The projecting part for agitating 7 is connected to the lower-half part 5 and the middle part 4 in such a way that the starting point 13, which is the point where the projecting part for agitating 7 is connected to the lower-half part 5, is arranged, in relation to the direction of the rotation of the drum, to be ahead of the end point 14, which is the point where the projecting part for agitating 7 is connected to the middle part (see FIGS. 3 and 5).

In the present embodiment the two projecting parts for agitating are provided at the inner surface of the drum D. But the number of projecting parts for agitating can be one, or more than one, such as three or four. Further, five or more projecting parts for agitating can be provided. But no improved agitating capability can be expected. So, preferably the number of projecting parts for agitating should be one to four.

Figure 4:
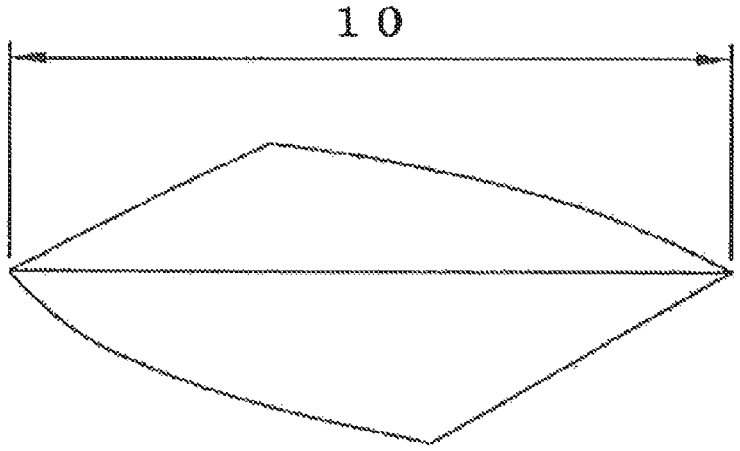
FIGS. 4(*a*), (*b*), and (*c*) are the drawings that show only the projecting part for agitating of FIG. 3, wherein the drawings give, respectively, a plan view, front view, and side view of the projecting part for agitating when it is laid horizontally.
Figure 4:
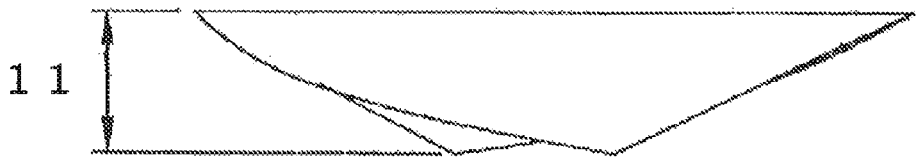
Figure 4:
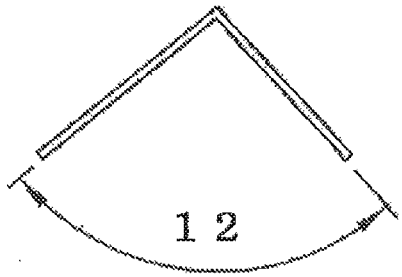

Preferably the length 10 of the projecting part for agitating shown in FIG. 4(*a*) is less than the length of a line parallel to the axis of rotation and the same height as the middle part of the drum (hereafter, a "generatrix") of the middle part 4. Preferably the height 11 shown in FIG. 4(*b*) is equal to or greater than ⅛ and equal to or less than ⅔ of the radius of the middle part 4 of the drum. If the length 10 of the projecting part for agitating were greater than the length of the generatrix of the middle part 4, the works to be treated would fall outside the drum when they were agitated. Also, if the height 11 of the projecting part for agitating were less than ⅛ of the radius of the middle part 4 of the drum, the surface for picking up would be too small for sufficiently scooping up the works to be treated. If the height 11 of the projecting part for agitating were more than ⅔ of the radius of the middle part 4 of the drum, the works to be treated would fall between the convex part 6 of the circular truncated cone 6 and the projecting part for agitating 7 and stuck in there or the projecting part for agitating 7 would wear down because the particles for treatment would be thrown directly against the projecting part for agitating 7.

Also, the angle 12 between the surface for picking up 8 and the surface for having the works slide down 9 as shown in FIG. 4(*c*) is preferably from 60° to 120°. If the angle 12 is large, the agitating capability is reduced, but it is preferable for the works to be treated that they should not be damaged with the traces of collision. If the angle 12 is small, the agitating capability increases, but it also increases the traces of collisions on the works to be treated.

Here the cross-section of the shape formed, by the surface for picking up 8 and the surface for having the works slide down 9 is triangular or trapezoidal.

The angle of twist 15 formed between the starting point 13 of the lower-half part of the drum and the end point 14 of the middle part of the drum, as shown in FIG. 5, is preferably from 50° to 120°. If the angle of twist 15 were narrower, the traces of the collisions on the works to be treated would be greater. Further, a sufficient agitating capability would not be obtained because the movement of the works to be treated W in the direction toward the part 1 nearer to the opening of the drum would be smaller. If the angle of twist 15 were wider, the works to be treated W would not be agitated, because they would not move toward the axis of the drum and would only fall off the projecting part for agitating 7.

Figure 7:
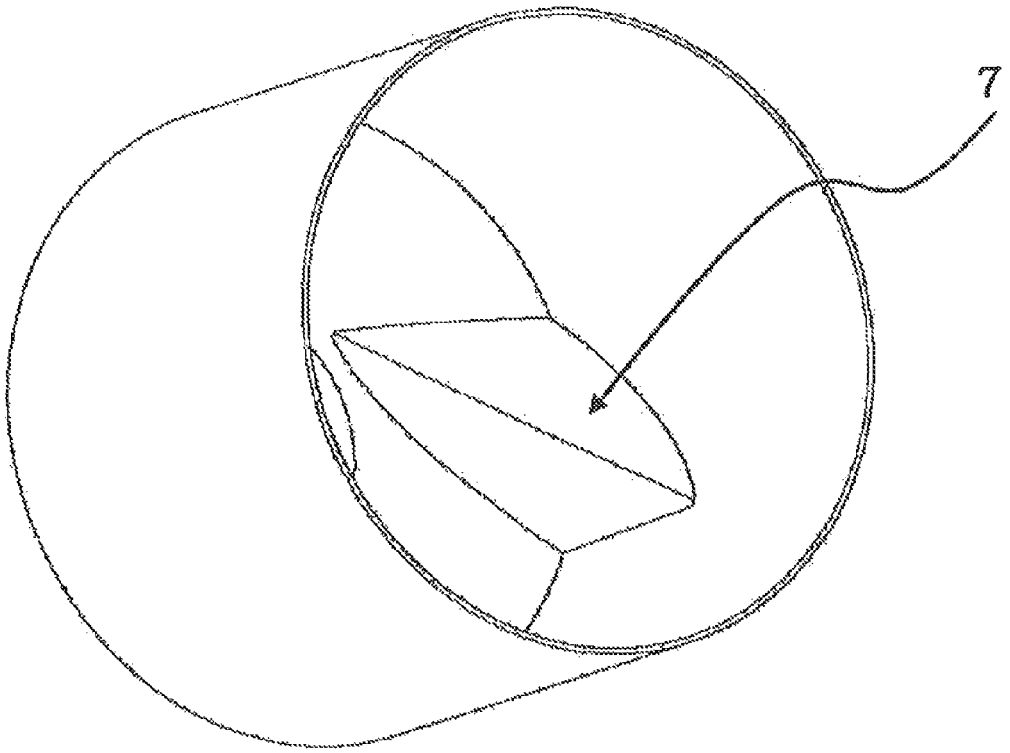
FIG. 7 is a perspective view of one embodiment of the drum for the shot blasting apparatus of the present invention (a part omitted).

FIG. 7 is a perspective view of the projecting part for agitating 7 of the drum for the shot blasting apparatus of the present invention.

Figure 6:
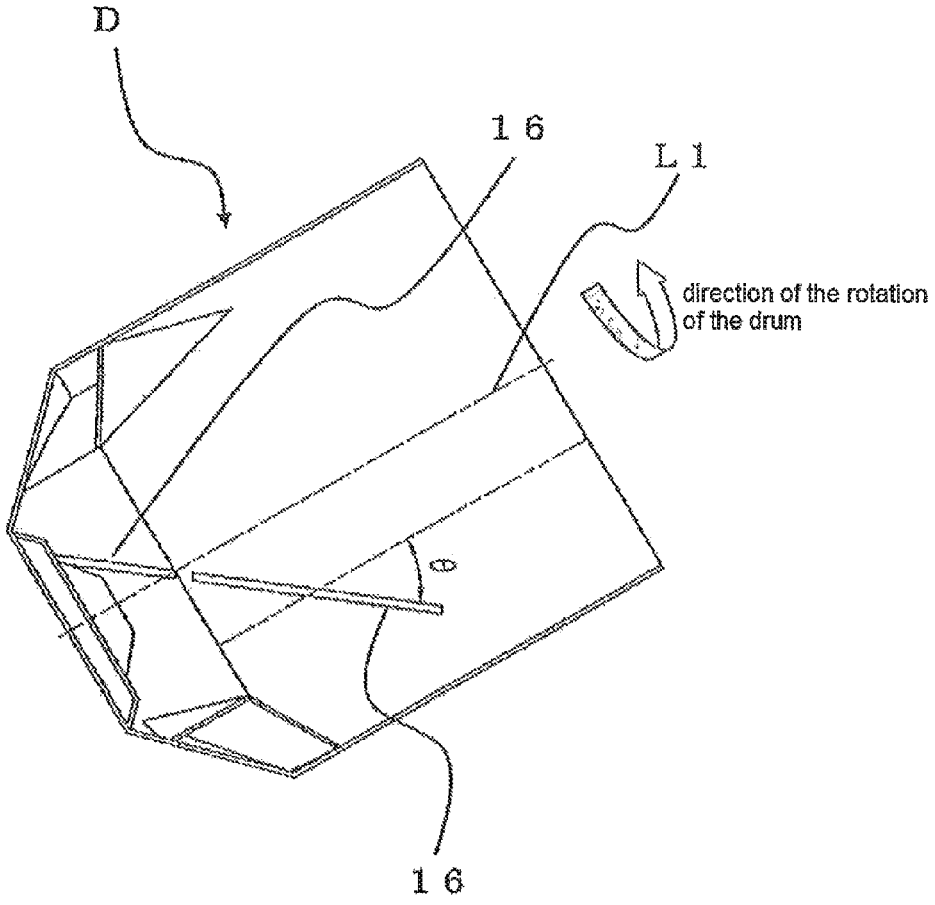
FIG. 6 is a view as seen from the direction B in FIG. 5 (a part omitted).

A plate-like-bar projection 16 to completely discharge the works that were treated is connected to the inner periphery of the lower-half part 5 of the drum D and to that of the middle part 4 of the drum D, and the plate-like-bar projection 16 is provided in a way that it is inclined relative to the generatrix of the middle part 4 (see FIG. 6). This plate-like-bar projection 16 is inclined at an angle of θ against the generatrix of the middle part 4, which is 15° to 60°, preferably 35° to 40°. The plate-like-bar projection 16 is inclined in such a way that the lower end of the plate-like-bar projection 16 (the part that is connected to the bottom of the drum) is ahead of the upper end part (the part that is nearer to the opening of the drum) relative to the direction of the rotation of the drum. Also, the plate-like-bar projection 16 is positioned so that it extends from the point nearer to the part where the lower-half part 5 is connected to the convex part 6 to the point above the end point 14 (the part nearer to the opening of the drum) of the projecting part for agitating 7 where the projecting part for agitating 7 is connected to the middle part 4. In the present embodiment, in light of the convenience of manufacturing, the plate-like-bar projection 16 is divided and provided separately, one at the lower-half part 5 and one at the middle part 4. But the plate-like-bar projection 16 can be installed in one piece. The cross section of the plate-like-bar projection 16 can be rectangular, having, for example, a height: 10-50 mm, width: 5-30 mm, more preferably, a height: 20-30 mm, width: 10-15 mm. A plurality of the plate-like-bar projections 16, for example, 2-8 pieces, can be installed at the positions where they do not interfere with the projecting part for agitating 7.

The drum D for the shot blasting apparatus of the present invention has many holes (not shown), as holes for discharging the particles for treatment, on the middle part 4 of a cylindrical shape and on the side wall of the lower-half part 5 of the circular truncated cone. The holes have sizes which the particles for treatment (shots) can get through but the works to be treated cannot.

Evaluation Tests

Below, the tests for comparing the agitating capability of the drum D of the present invention with that of the conventional drum were carried out and the results of the tests were evaluated.

The drum D used for the tests for a comparison in this embodiment has the middle part 4 of a cylindrical shape, having a diameter of 700 mm and a length of 620 mm, and has the lower-half part 5 of the circular truncated cone having a closed bottom, with the bottom of the lower-half part 5 having a diameter of 345 mm. The section of the lower-half part 5 is connected to the middle part 4 having a diameter of 700 mm. The height of the lower-half part 5 is 44 mm.

The drum D used in this embodiment and the conventional drum used for the test have the same shape.

Also, the drum D of the present invention used for the test for a comparison in this embodiment is provided with two projecting parts for agitating 7, where the angle 12 between the surface for picking up 8 and the surface for having the works slide down 9 was set at 92°, and where the height 11 of the projecting part for agitating 7 was set at 102 mm and the angle of twist 15 was set at 61°.

Figure 1:
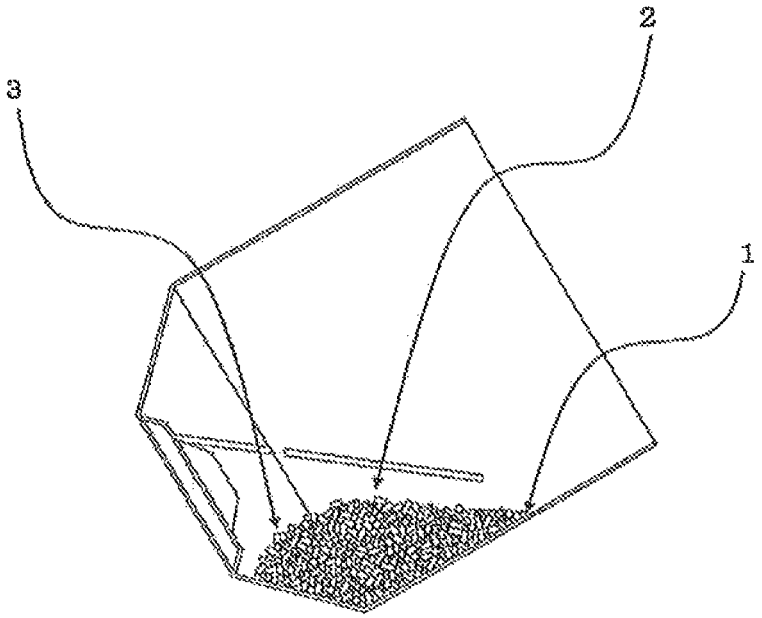
Prior Art Fig. 1
FIG. 1 is a cross-sectional drawing of a conventional drum comprising the works to be treated.
Figure 2:
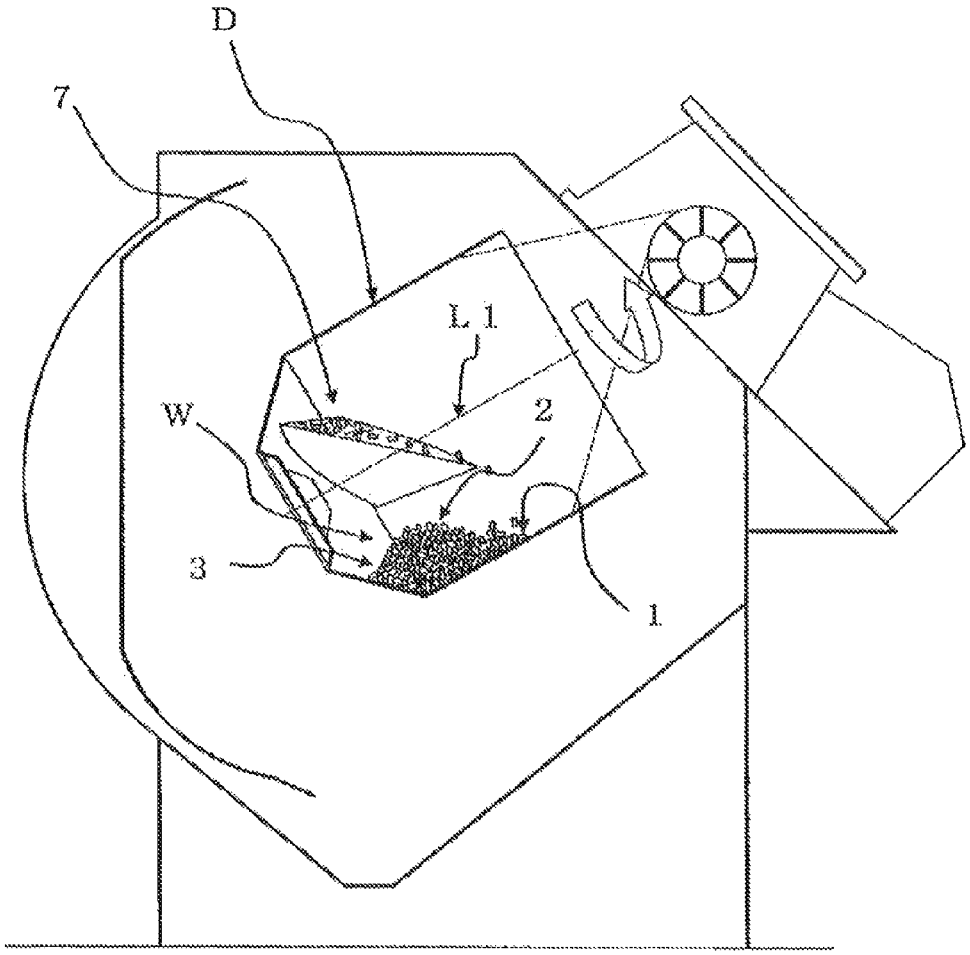
FIG. 2 is a cross-sectional drawing of the shot blasting apparatus using the drum for the shot blasting apparatus of the present invention when treating the works to be treated, with a part of the drawing omitted.

The test was carried out under the following conditions:

The works to be treated were pan head small screws with cross-shaped grooves (M5×20); the amount of the works to be treated was 80 kg; the rotational speed of the drum was 3.65 rpm, The drum was attached to the shot blasting apparatus as shown in FIG. 2 so that the axis for rotation of the drum formed an angle of 30° against the horizontal line.

The testing method was as follows:

One piece that was taken from the works to be treated that were placed in the amount of 80 kg in the drum was painted, and the number of times that that painted piece appeared above the surface of the works to be treated was visually counted. The same tests were repeated three times and the results were evaluated based on the mean values.

Figure 8:
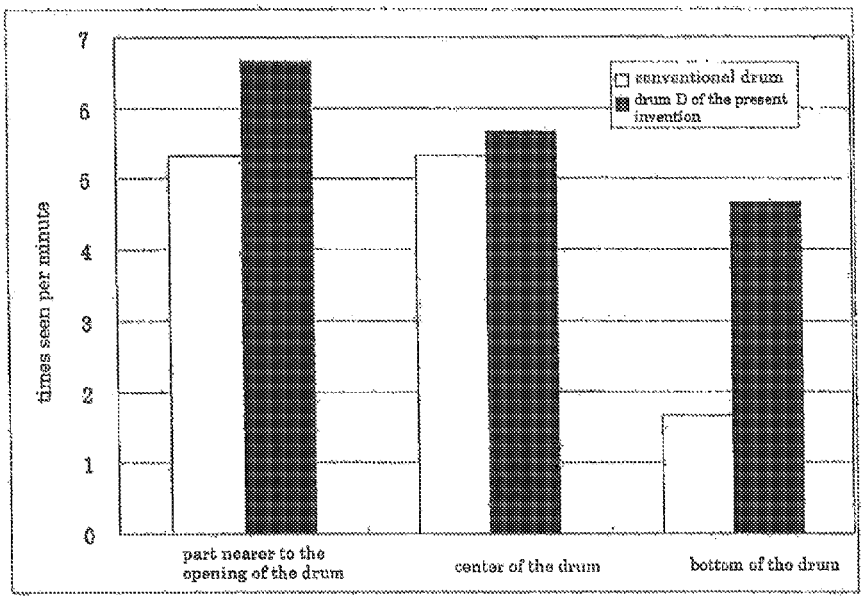
FIG. 8 shows the results of the tests of the comparative examples.

The results of the evaluation are given by a graph that is shown in FIG. 8.

The results show that the agitating capability for the works to be treated that are buried at the bottom 3 of the drum D, which works that are buried at the bottom are usually hard to agitate, improved from 1.7 times/min of the conventional drum to 4.7 times/min of the drum of the present invention, which is an improvement of about 2.8 times.

The middle part 4 of the drum D in the present embodiment has a cylindrical shape. But it can also have the shape of a hollow polygonal pillar or a combination of a cylinder and a hollow polygonal pillar. Also, the lower-half part 5 of the drum can have a cylindrical shape or U-shape.

Further, the convex part 6 of the drum can have the shape of a circular cone, a circular truncated cone, a square pyramid, a square pyramid of trapezoidal shape, a pyramid, or a pyramid of a trapezoidal shape.

Figure 9:
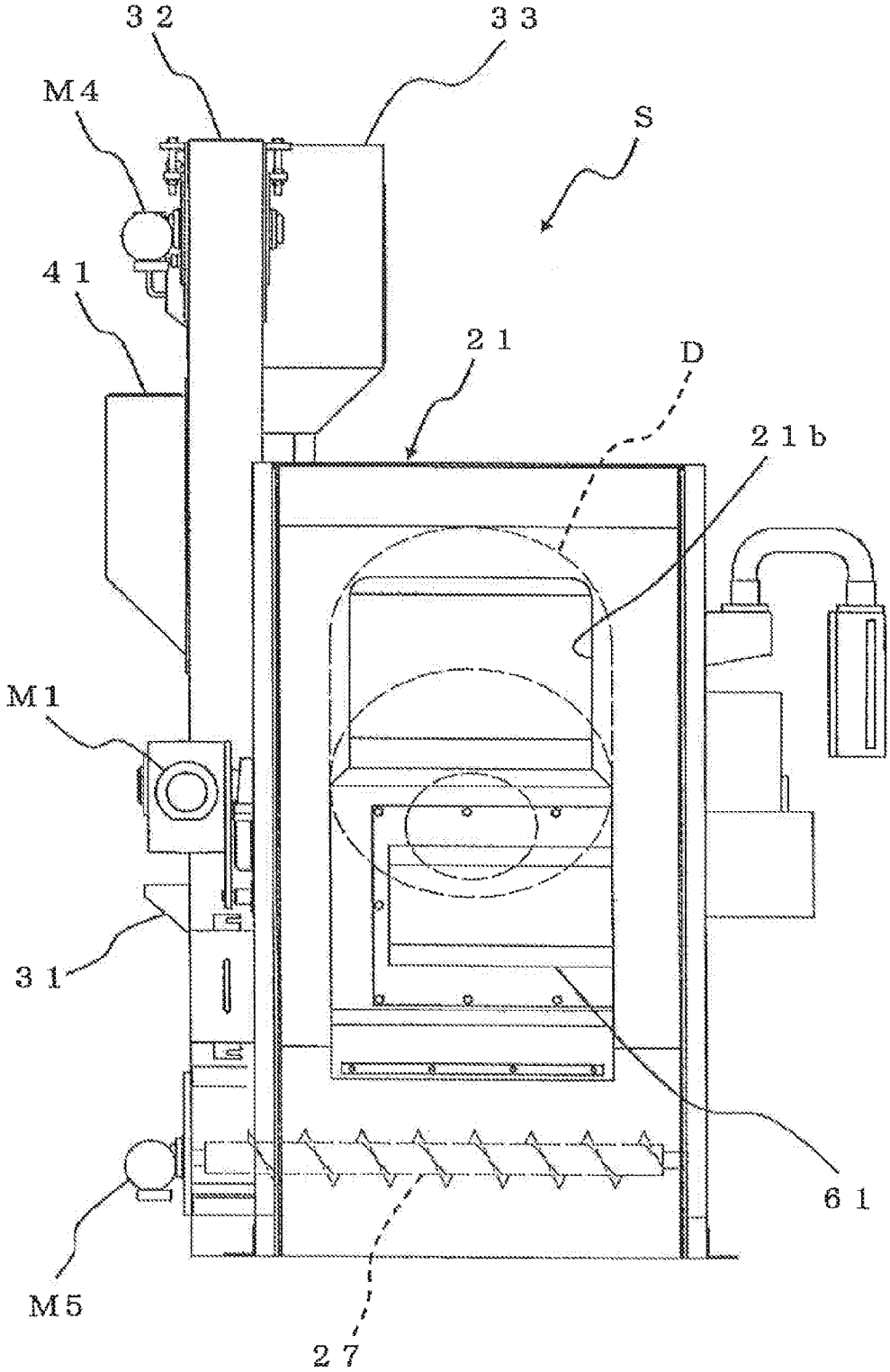
FIG. 9 is a front view of the shot blasting apparatus in one embodiment of the present invention.
Figure 10:
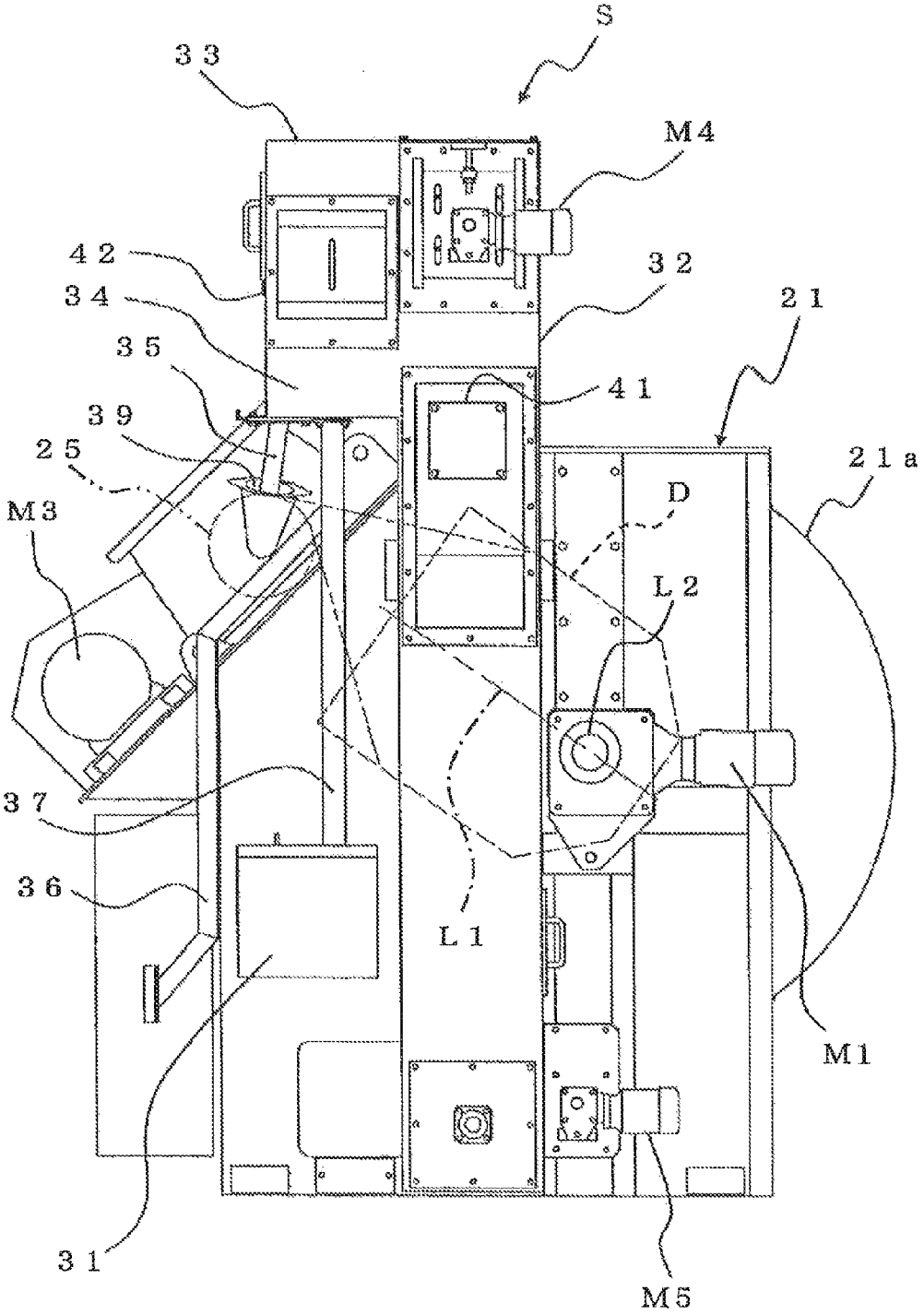
FIG. 10 is a left-side view of the shot blasting apparatus in one embodiment of the present invention.
Figure 11:
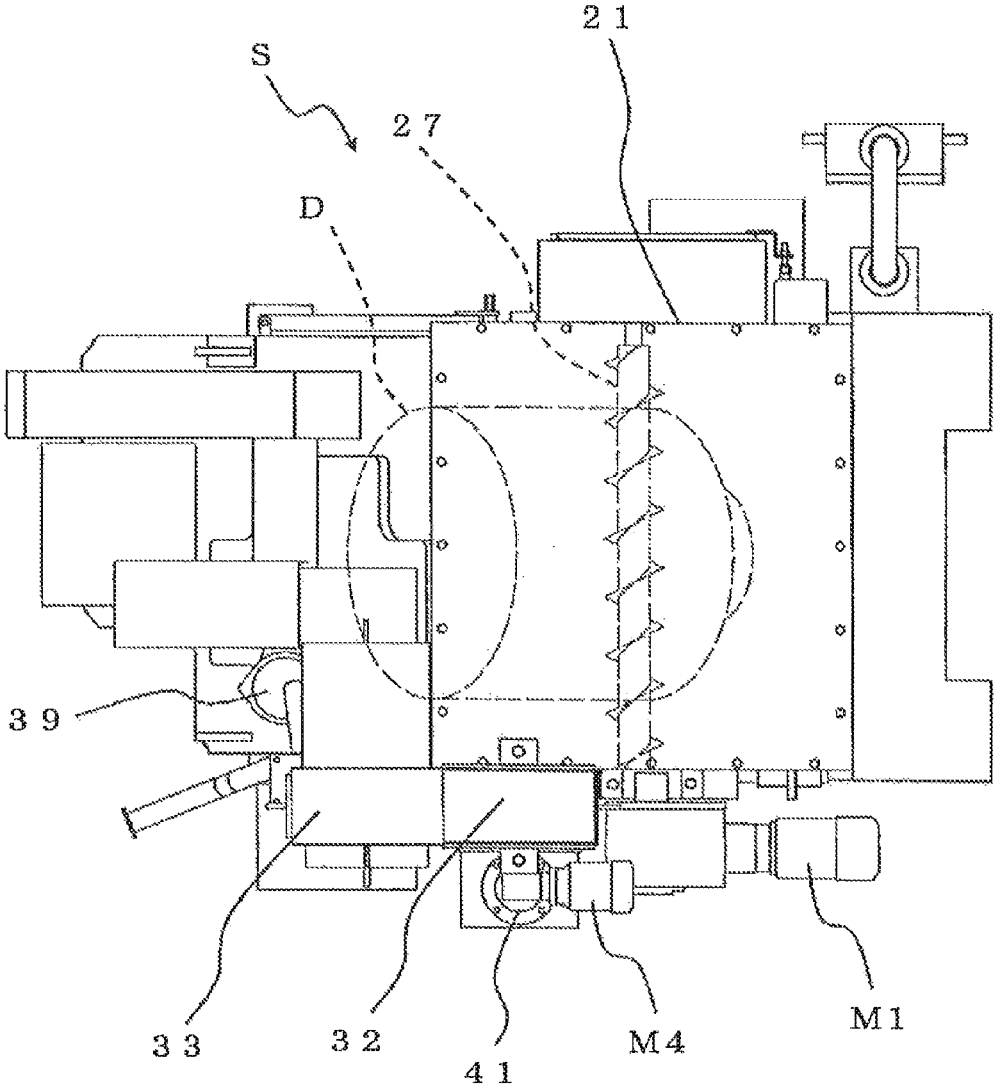
FIG. 11 is a plan view of the shot blasting apparatus in one embodiment of the present invention.

Next, the shot blasting apparatus that uses a drum for the shot blasting apparatus of the present invention is explained (FIGS. 9-11). In the explanation below, the expression "above or below" the cover and "ahead or behind" the cover is based on the position of the cover when it is closed (when the works are being treated), unless otherwise specified.

The shot blasting apparatus S that uses the drum for the shot blasting apparatus of the present invention is, as stated above, used for treating the works to be treated such as for descaling, trimming, etc., of the small articles and thin parts.

The shot blasting apparatus S comprises a cabinet 21, a drum D, and a centrifugal injecting device 25.

The cabinet 21 has a totally enclosed structure so that the particles for treatment that were injected do not scatter outside when the particles are injected in the drum.

The drum D has a projecting part for agitating. This drum is a vessel that uniformly treats the works by injecting the particles for the treatment while the drum rotates the works that are stored in the drum within the cabinet 21. The drum D can turn around the axis for turning L2 of the drum, which axis perpendicularly penetrates the axis for rotation L1 of the drum D and which is horizontally positioned. Thus the drum can turn around within the cabinet 21 and can be stopped at the positions for supplying the works to be treated, for treating the works, and for discharging the works that were treated.

The centrifugal injecting device 25 is disposed above and behind the cabinet 21. It accelerates the movement of the shots (particles for treatment) and injects them through the opening of the drum D.

A device for supplying the particles for treatment that is used when treating the works to be treated is disposed on one side (left-hand side) of and behind the shot blasting apparatus S.

The device for supplying the particles for treatment comprises a bucket elevator 32 that moves upward the particles for treatment that were supplied into the cabinet 21 from a box for supplying the particles for treatment 31, a separator 33 that communicates with an upper aperture for discharging of the bucket elevator 32, a hopper 34 disposed below the separator 33, a pipe for supplying the particles for treatment 35, a pipe for discharging crushed particles 36, etc. A screw conveyor 27 for recovering the particles for treatment is disposed at the lower part (bottom) of the cabinet 21, and the part of the screw conveyor 27 from where the particles for treatment are discharged is connected to the bucket elevator 32. By means of the screw conveyor 27 and the bucket elevator 32, the particles for treatment after they are injected are recovered together with the dust, scales, etc., that were produced in a treating step. From the items that are recovered, the particles for treatment that are reusable are separated by the separator 33 (wind classifier) and can be recycled (returned) to the centrifugal injecting device 25.

The crushed particles such as the particles for treatment that are classified by the separator 33 using a force of wind can be discharged through the pipe for discharging crushed particles 36.

Also, the bucket elevator 32 and the separator 33 communicate with the cabinet 21, thereby forming a continuously enclosed, space, which space is connected to a dust collector (not shown) by connecting ducts 41 and 42.

The bucket elevator 32 is connected, to the dust collector to suction the dust that is mainly produced in the cabinet 21.

The separator 33 is connected to the dust collector to eliminate light items such as dust, scales, and the particles for treatment that are not reusable, before the reusable particles for treatment are separated from the particles for treatment that are recovered and recycled to the centrifugal injecting device 25.

Also, the particles for treatment that are separated by the separator 33 using the force of wind and that are heavier than the dust but lighter than the reusable particles for treatment (the particles produced by abrasion or crushing), scales, etc., are discharged outside the shot blasting apparatus S through the pipe for discharging crushed particles 36 that is connected to the separator 33.

The particles for treatment that are separated by the separator 33 using the force of wind and that are reusable are transported to an input port 39 for the particles for treatment through the pipe for supplying the particles for treatment 35 which communicates with the hopper 34.

The particles for treatment that exceed the storage capacity of the hopper 34 are transported to the box for supplying the particles for treatment 31 through a pipe for transporting the surplus particles for treatment 37 and then recycled to the centrifugal injecting device 25 by means of the screw conveyor 27 and the bucket elevator 32.

The drum D is driven by a motor for driving M2 (motor for rotating) that rotates the drum by means of a rotating shaft 81. At the end of the rotating shaft 81 on the side of the drum is provided a protrusion in a convex-shape 82, which engages with a positioning hole that is disposed at the center of the bottom of the drum. Then a flange on the side of the drum and one on the side of the rotating shaft are fastened with screws. By providing the rotating shaft 81 with the protrusion in a convex-shape 82, the positioning of the drum, if the drum needs to be replaced because of wear, etc., can easily be carried out and thus minimizing the time for replacing the drum can be achieved.

Further, an external cylinder 85 that covers the middle part of the drum D is provided around the outer surface of the drum D. An axis for turning the external cylinder 85 is identical with the axis L2 of the drum D that is horizontal and goes through the axis for rotation L1 of the drum D. Thus the external cylinder 85, together with the drum D and the motor for driving M2 that gives the drum a rotating motion, are turned by a motor for driving M1.

The external cylinder 85 has a guide-flap 77 for discharging the works that were treated. The guide-flap is attached to a part of the external cylinder 85 so that the guide-flap 77 can be disposed at the lower part of the drum when. the opening of the drum is turned to the position for discharging the works that were treated (see FIG. 19). Thus the guide-flap 77 has the role of smoothly discharging the works that were treated from the drum into a receiving container 90 (see FIG. 19).

The centrifugal injecting device 25 is driven by the motor for driving M3, whose driving force is transmitted by a belt.

Also, the bucket elevator 32 and the screw conveyor 27 are driven by motors for driving M4 and M5, respectively.

Next the characteristic features in one embodiment of the shot blasting apparatus of the present invention are explained.

Figure 12:
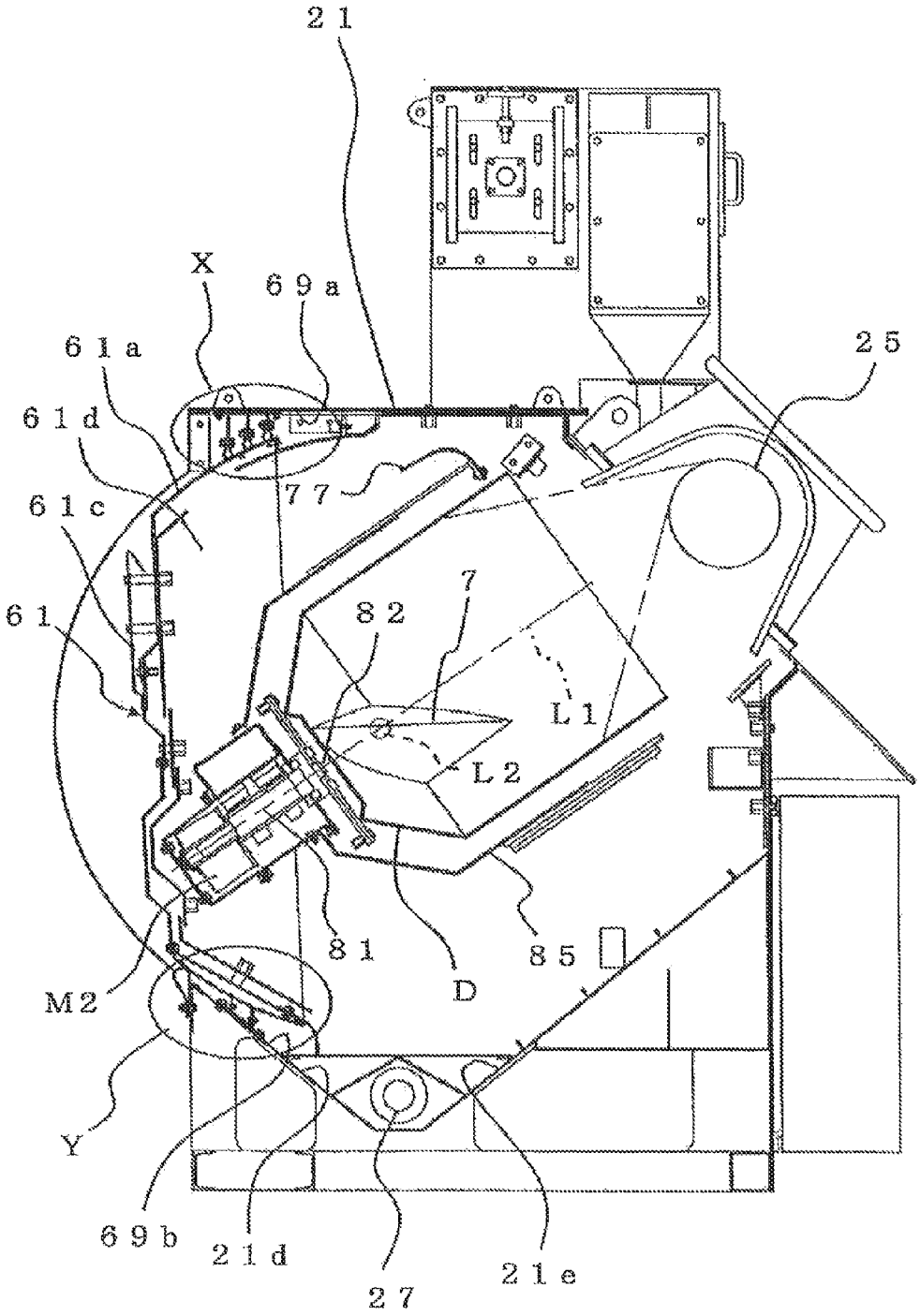
FIG. 12 is a cross-sectional view of the shot blasting apparatus in one embodiment of the present invention (a part omitted).
Figure 13:
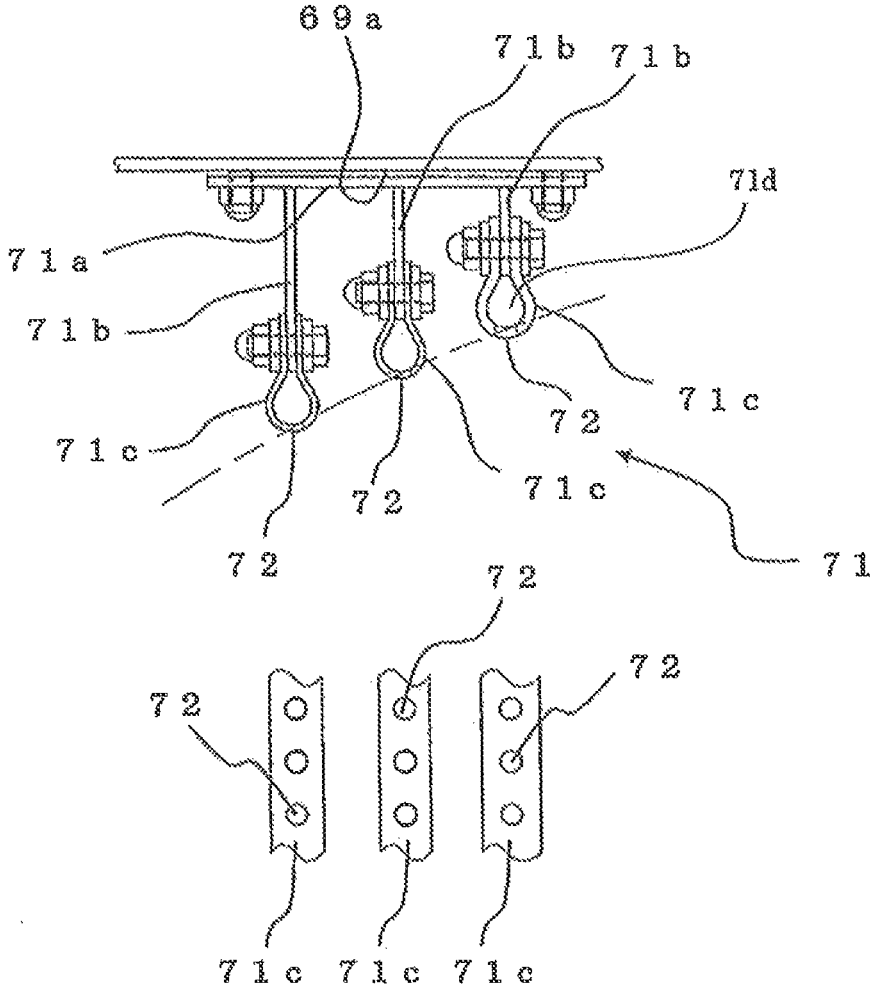
FIG. 13 shows an enlarged cross-sectional view of the part marked with an X of FIG. 12 and the part as seen from below.
Figure 14:
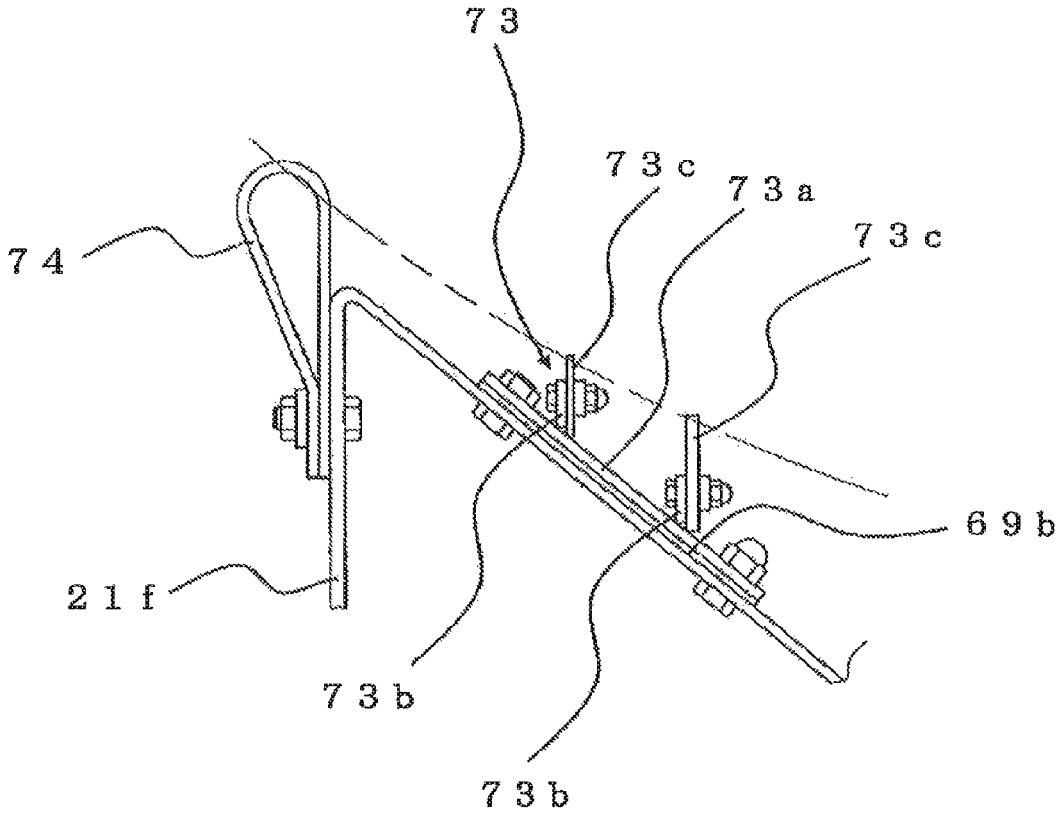
FIG. 14 is an enlarged cross-sectional view of the part marked with a Y of FIG. 12.
Figure 15:
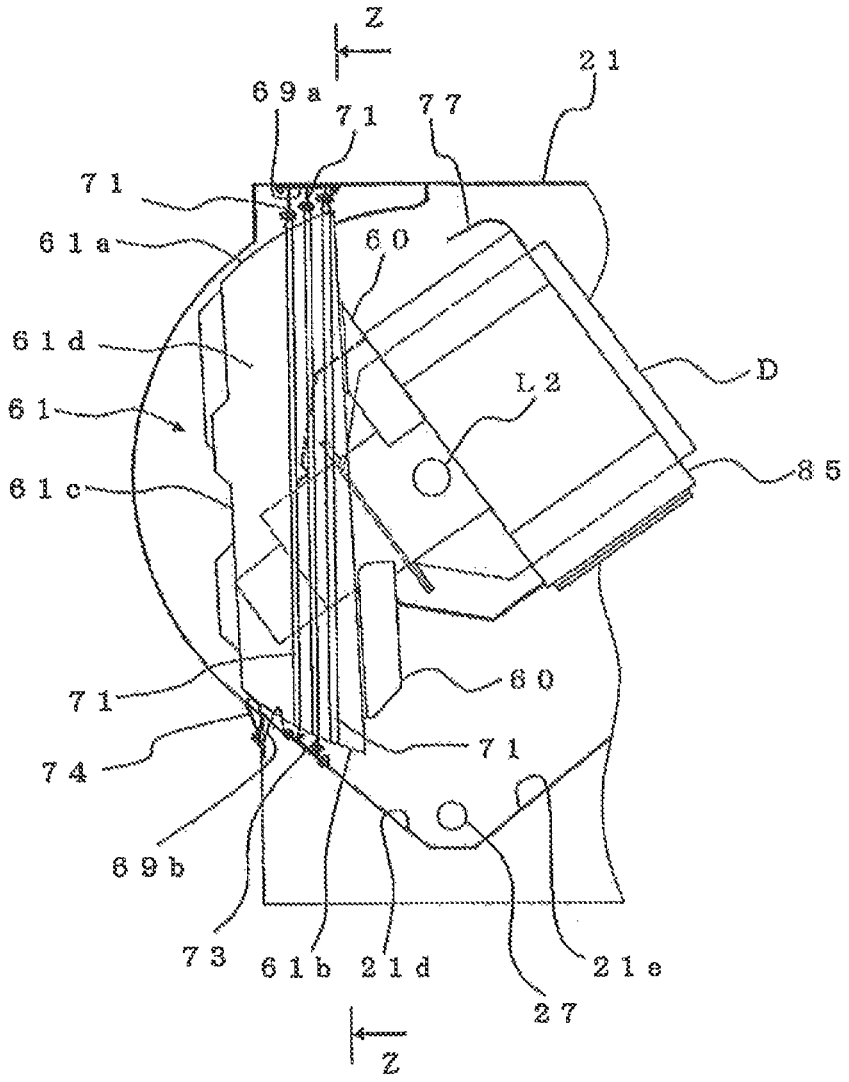
FIG. 15 gives the relationship of the cabinet, each sealing member, and the cover in their cross section when the cover is closed.
Figure 16:
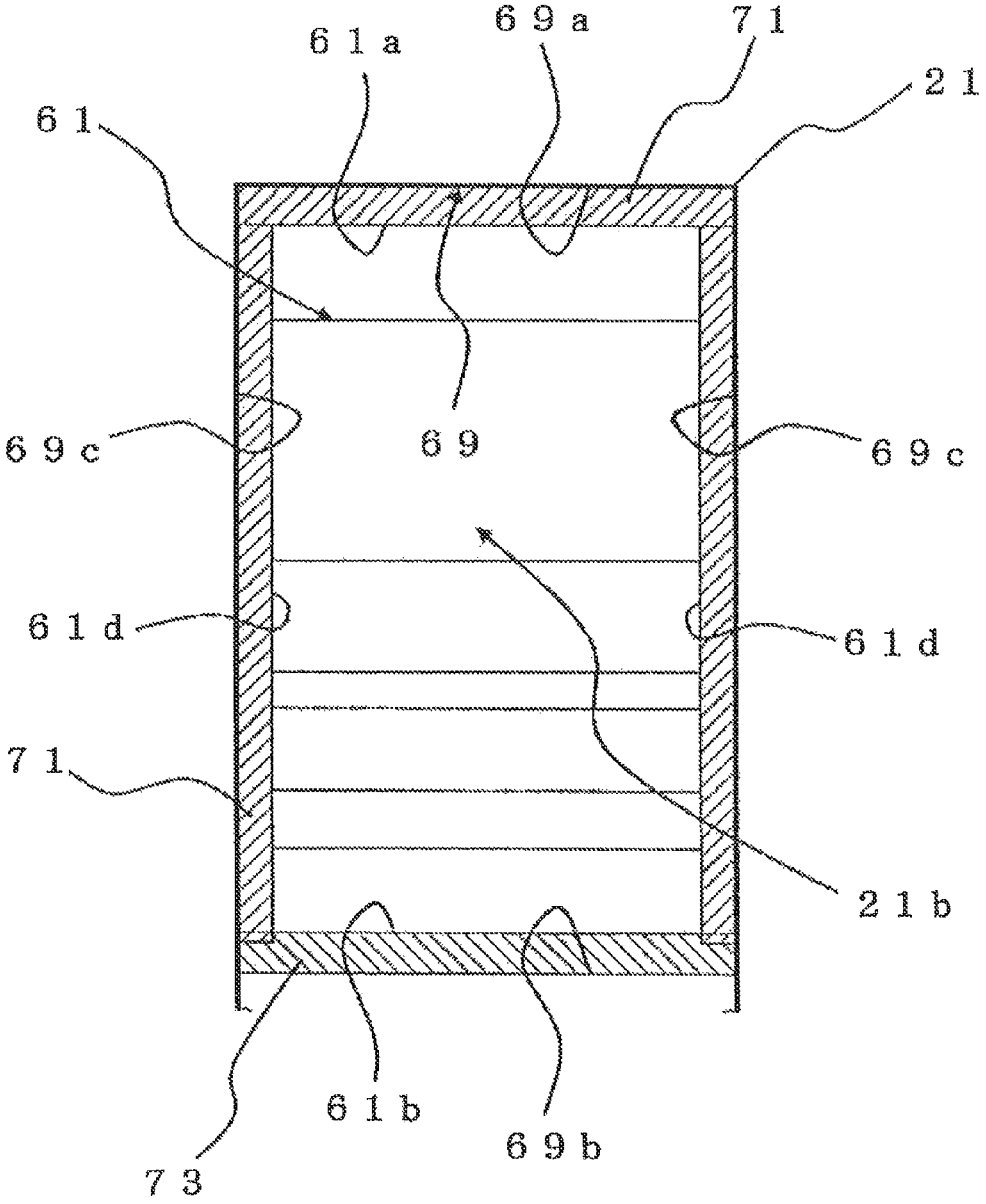
FIG. 16 is a cross-sectional view of the shot blasting apparatus at the line Z-Z and as seen in the direction shown by arrows in FIG. 15.

Basically, a cabinet 21 comprises a cover 61 that can close an opening 21*b* for supplying the works to be treated and discharging them when treated. Further, it comprises a sealing-wall member 69 on the side of the opening 21*b* of the cabinet 21, consisting of a ceiling-wall 69*a*, a floor-wall 69*b*, and both side walls 69*c*, 69*c*. (See particularly FIGS. 12, 15, and 16.)

The cabinet 21 has an arched and protruding wall 21*a*, 21*a*. The forward part of the cabinet 21, where the arched and protruding wall 21*a* is formed, has a shape of a vertical arc-like wall, with an opening 21*b*, the width of which is larger at the lower part. At the bottom of the cabinet 21 the screw conveyor 27 is provided in the width direction, and the walls at the bottom 21*d*, 21*e*, which walls are opposed, are inclined so that particles for treatment that were injected accumulate toward the screw conveyor 27.

The cover 61 is attached to the drum D by means of frames 60, 60 (see FIG. 15) in such a way that the cover 61 and the drum D can turn around as one body. The cover 61 has a shape of a boat where the cover consists of upper and lower arch-like wall members 61*a*, 61*b*, that can engage with a sealing-wall member 69, a string-like wall member 61*c* that is connected to both anterior ends of the upper and lower arch-like wall members 61*a*, 61*b*, and both side-wall members 61*d*, 61*d*, that connect the string-like wall member 61*c* to the upper and lower arch-like wall members 61*a* and 61*b*, respectively.

The sealing members, each with the shape of a lip, being lined in at least one row are disposed to seal gaps between the upper and lower arch-like wall members 61*a*, 61*b* of the cover 61 and the sealing wall member 69, and to seal gaps between both side-wall members 61*d*, 61*d* of the cover 61 and the sealing wall member 69.

In the drawings, for the convenience of manufacturing, the first sealing members 71 are disposed in three rows, namely, at the ceiling-wall 69*a* of the sealing wall member 69 and at both side walls 69*c*, 69*c*. The second sealing members 73 are disposed in two rows, i.e., at the floor-wall 69*b*. Further, the third sealing members 74 are disposed in a row along a bent wall 21*f* at the lower end of the opening 21*b* of the cabinet 21.

The first and second sealing members 71, 73 have the shape of a lip. That is, the sealing members have base parts 71*a*, 73*a*, that are fixed to the sealing wall member 69 by screws, where the base parts 71*a*, 73*a* have the predetermined number of rows of fins for fastening 71*b*, 73*b* protruding from the base parts, to which fins for fastening 71*b*, 73*b* the sealing-lip members 71*c*, 73*c* are screwed, respectively.

The sealing-lip member 71*c* of the first sealing member 71 is made of a band in the shape of a strip. It is bent to form a ring where apertures for discharging the particles for treatment 72 are provided at the predetermined space (for example, 20-100 mm). The sealing-lip member has a U-shape cross section at its end.

By forming the end of the sealing members to have the U-shaped cross sections, the sealing capacity and the capacity for blocking the particles for treatment by the first row of the sealing members increases.

Figure 19:
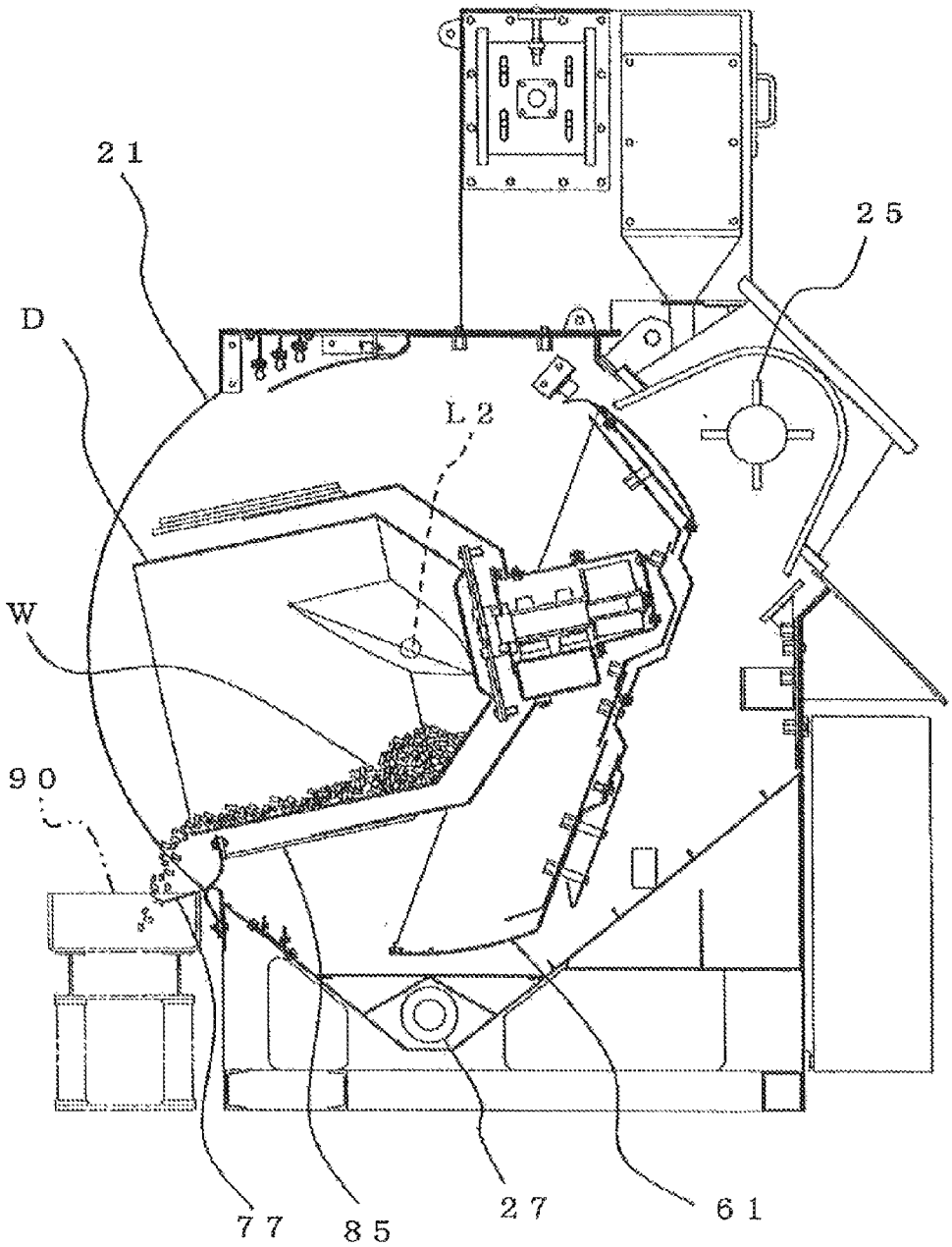
FIG. 19 is a cross-sectional view of the shot blasting apparatus that shows the position of the drum when the works to be treated are discharged (a part omitted).

Also, the first sealing member 71 is not formed as one body that has a flexural area (an inverted U-shape in its front view). But, for the convenience of manufacturing and fastening the sealing member 71, the sealing member 71 is made of separate parts, namely, the part on the ceiling side, which part is attached to the ceiling-wall 69*a*, and the part on the side-wall, which part is attached to each of both side walls 69*c*. So, apertures for discharging the particles for treatment 72 of the sealing-lip members 71*c* of the first sealing member 71 are required. That is, if the particles for treatment pass through the gap between the fastening of the sealing member on the ceiling side and the fastening of the sealing member on the side walls, and enter the inside 71*d* of the sealing-lip member 71*c* on the ceiling side, the apertures for discharging the particles for treatment 72 discharge them outside the sealing-lip member 71*c* on the ceiling side when the works that were treated are discharged (FIG. 19).

The sealing-lip member 73*c* of the second sealing member 73, which is made of a band in the shape of a strip, keeps that shape, and works as a fin. The second sealing member 73 is formed in a fin-shape because the particles for treatment are least likely to reach the position of the anterior inclined bottom wall 21*d* of the cabinet 21, that is, the position where the second sealing member 73 is attached. So, the second sealing member 73 does not need to have the structure that the first sealing member 71 does, but it only needs to prevent the dust that is produced from leaking out.

The third sealing member 74 is made of a band in the shape of a strip that is curved. It has a structure wherein the band in the shape of a strip is folded so as to surely prevent dust from leaking out. So, there need be only the second or the third sealing member.

Next, the process of shot blasting of the shot blasting apparatus as explained above is the following (see mainly FIGS. 17-19):

As preparation for shot-blasting, the particles for treatment (shots) are supplied in advance in the cabinet 21 from the box for supplying the particles 31 of the bucket elevator 32.

Figure 17:
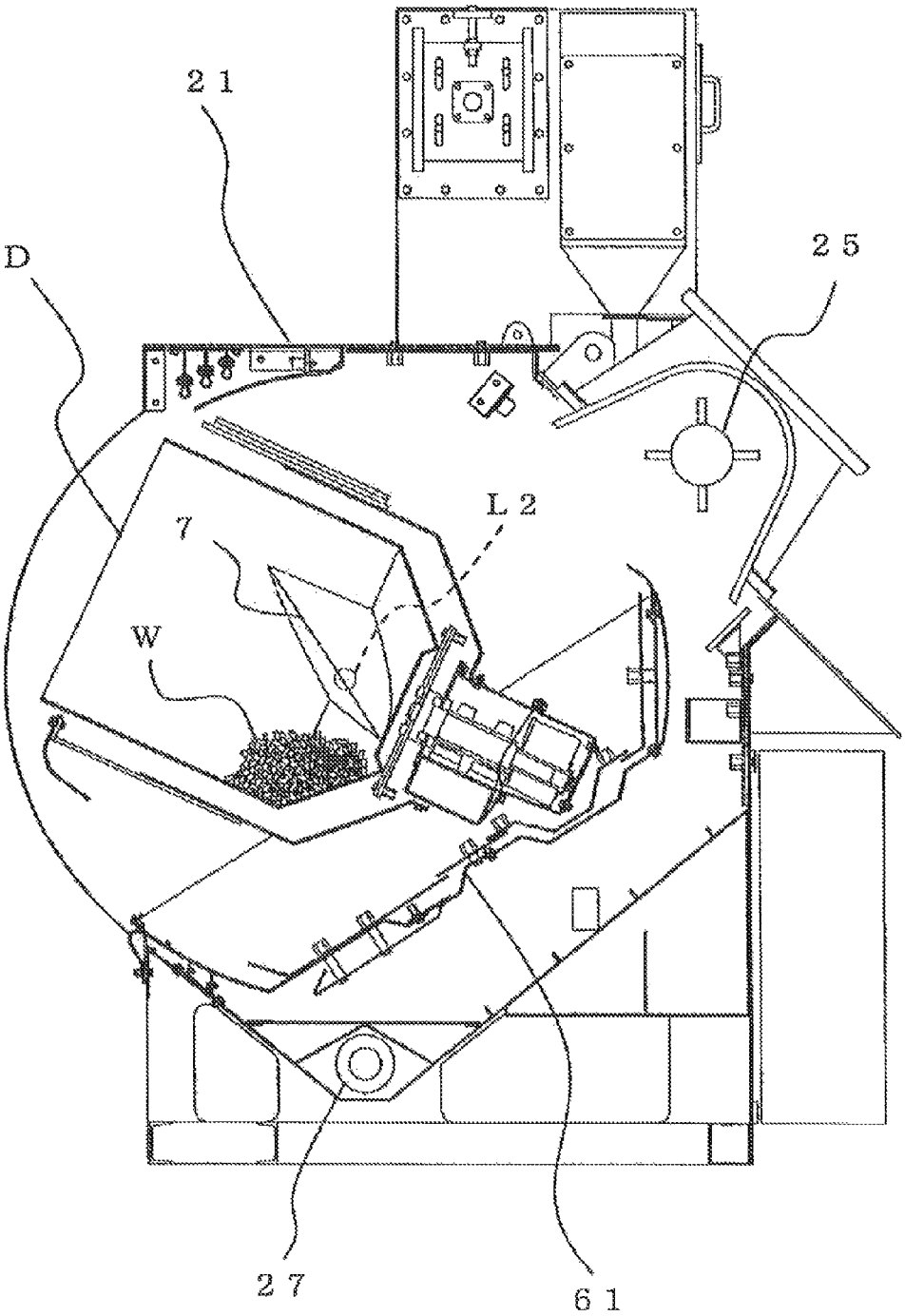
FIG. 17 is a cross-sectional view of the shot blasting apparatus that shows the position of the drum when the works to be treated are supplied (a part omitted).
Figure 18:
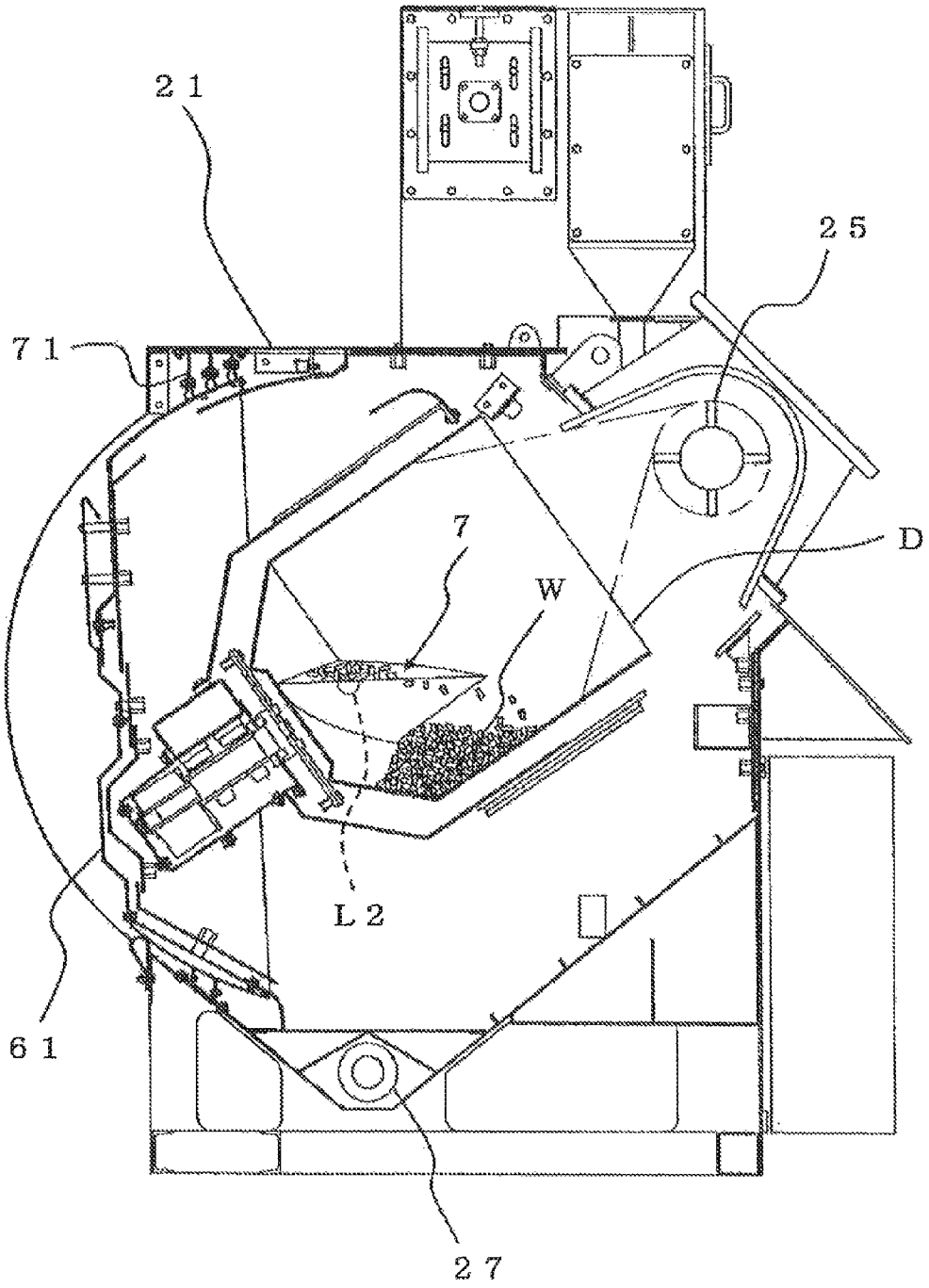
FIG. 18 is a cross-sectional view of the shot blasting apparatus that shows the position of the drum when the works to be treated are treated (a part omitted).

Next, the drum D is turned to the position for supplying the work to be treated as shown in FIG. 17. At the position for supplying the work to be treated, the cover 61 that is turned in one body together with the drum D is at an open position where the works to be treated can be supplied through the opening 21*b* that is at the front side of the cabinet 21. The works to be treated are supplied to the drum D that is at the position for supplying the works to be treated. Any means for supplying the works to be treated can be used.

Then the drum D is turned and placed at the position for treating the works (FIG. 18) where the cover 61 is at the closed position and the cabinet 21 is closed. With the cover 61 and the cabinet being kept under these conditions, the drum D is rotated by driving the motor for driving M2. At the same time the centrifugal injecting device 25, the bucket elevator 32, the screw conveyor 27, and the dust collector (not shown), are operated by driving the motors for driving M3, M4, M5.

Then the particles for treatment are supplied from the bucket elevator 32 to the centrifugal injecting device 25 through the separator 33, the hopper 34, and the pipe for supplying the particles for treatment 35. From the centrifugal injecting device 25 the particles for treatment are thrown toward the works to be treated in the drum D. The works to be treated W in the drum D that is rotating are uniformly agitated by the projecting part for agitating 7 and a uniform treatment of the works to be treated is carried out.

Even if the particles for treatment were to enter the gap between the cover 61 and the sealing-wall member 69 of the cabinet, the gap would be sealed with. the first and second sealing members 71, 73. So, they would not leak out of the cabinet 21.

Also, even if the particles for treatment were to enter the inner part 71*d* of the sealing-lip member 71*c* after they pass through the gap between the part connecting the ceiling-side to the side-wall of the first sealing member 71, they would fall through the apertures for discharging the particles for treatment 72 at the end of the part having a U-shaped cross section, when the cover is opened (when the works that were treated are discharged). Then they would be returned to the outside of the sealing-lip member 71*c*, that is, to the inside of the cabinet 21.

The particles for treatment that are returned to the inside of the cabinet 21 fall along the anterior inclined bottom wall 21*d* until they reach the screw conveyor 27. Then they are recycled together with the other particles for treatment that were injected.

When the treatment of the works is completed, the driving motor M3 is stopped and the centrifugal injecting device 25 stops. In this instance the drum D still keeps rotating. So, the particles for treatment within the drum D are discharged from the drum through the apertures for discharging the particles for treatment 72 (they fall within the cabinet 21). The time required for the particles for treatment within the drum D to be completely discharged varies depending on the quantities, shapes, and sizes of the works to be treated and those of the particles for treatment. Therefore, in some cases, discharging the particles for treatment within the drum D can be completed in a short time. But after the particles for treatment are injected, the cabinet is filled with floating dust. So, it would not be preferable in light of the working environment to have the cover 61 move to the open position, because such an operation would allow the dust within the cabinet to leak from the cabinet 21.

To have the cabinet 21 be ventilated by a dust collector so that the concentration of the dust within the cabinet is reduced to the same level as the outside air, it takes the same time as for the dust collector to suction a volume that is three times the volume of the cabinet 21. Even when the particles for treatment are being discharged, the dust collector still operates. So, if the time required for discharging the particles for treatment is more than that that the dust collector needs to suction the volume that is three times the volume of the cabinet 21, the dust within the cabinet can be removed. So, the use of such a dust collector is desired.

If the time required for discharging all the particles for treatment within the drum D passes, or if the time passes that is required for the dust collector to suction sufficient dust so that the concentration of the dust within the cabinet is reduced to the same level as that of the outside air, then the drum D is further turned by the motor for driving M1 to the position for discharging the works that were treated, the works that were treated are discharged (FIG. 19). At this time a guide-flap 77 attached to the external cylinder 85 is positioned below the drum D, which is at the position for discharging the works that were treated. By placing a receiving container 90 at the position so that the guide-flap 77 is positioned inside the receiving container 90 that receives the works that were treated, the works that were treated are smoothly discharged. Further, by means of the plate-like-bar projection 16 within the drum D, all the works that were treated can be completely discharged by the rotation of the drum D. The motor for driving M2 is stopped when all the works that were treated are discharged.

Thus a series of steps comprising supplying the works to be treated, treating the works to be treated, and discharging the works that were treated, are completed. If any batch treatment of the works to be treated follows, the drum D is turned by the motor for driving M1 to the position for supplying the works to be treated, and the steps of supplying the works to be treated, treating the works to be treated, and discharging the works that were treated, are repeated.

The basic Japanese Patent Application, No. JP2010-140938, filed Jun. 21, 2010, is hereby incorporated in its entirety by reference in the present application.

The present invention will become more fully understood from the detailed description of this specification. However, the detailed description and the specific embodiment illustrate desired embodiments of the present invention and are described only for the purpose of explanation. Various changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not pose a limitation on the scope of the invention unless otherwise claimed.

SYMBOLS

D drum
W work to be treated
4 middle part
5 lower-half part
6 convex part
7 projecting part for agitating
8 surface for picking up
9 surface for having the works slide down
10 length of projecting part for agitating
11 height of projecting part for agitating
13 starting point of the lower-half part of the drum
14 end point of the middle part
15 angle of twist
16 plate-like-bar projection
21 cabinet
25 centrifugal injecting device
61 cover
61*a* upper arch-like wall member
61*b* lower arch-like wall member
61*c* string-like wall member
61*d* both side-wall members
69 sealing-wall member
69*a* ceiling-wall
69*b* floor-wall
69*c* side-walls
71 first sealing member
71*c* sealing-lip member
73 second sealing member
73*c* sealing-lip member
77 guide-flap
85 external cylinder
L1 axis for rotation
L2 axis for turning

The invention claimed is:

1. A drum for a shot blasting apparatus that carries out treatment of works to be treated by injecting particles for treatment into the drum, while the drum, into which the works to be treated are supplied, rotates, comprising:

a hollow middle part;

a lower-half part having a shape of a cone, a circular truncated cone, or U-shape, and having a closed bottom;

a convex part that is connected to the lower-half part and whose height is less than that of the lower-half part; and a projecting part for agitating that is connected to both the lower-half part and the middle part, and that agitates the works to be treated:

wherein the middle part of the drum has a cylindrical shape, a shape of a hollow polygonal pillar or a combination of a cylinder and a hollow polygonal pillar;

wherein the convex part of the drum has a shape of a circular cone, a circular truncated cone, a square pyramid, a square pyramid of trapezoidal shape, a pyramid, or a pyramid of a trapezoidal shape;

wherein the projecting part for agitating of the drum has at least two surfaces, one being the surface for picking-up the works to be treated and the other being the surface for having the works slide down; and wherein an angle between the surface for picking up and the surface for having the works slide down is from 60° to 120°.

2. The drum for the shot blasting apparatus of claim 1, wherein the drum has one projecting part for agitating.

3. The drum for the shot blasting apparatus of claim 1, wherein the drum has a plurality of projecting parts for agitating.

4. The drum for the shot blasting apparatus of claim 1, wherein the length of the projecting part for agitating is less than the length of a line parallel to the axis of rotation and the same height as the middle part of the drum (hereafter, a "generatrix") of the middle part and the height of the projecting part for agitating is equal to or greater than ⅛ and equal to or less than ⅔ of the radius of the middle part of the drum.

5. The drum for the shot blasting apparatus of claim 1, wherein the cross-section of the shape formed by a surface for picking up and a surface for haying the works slide down is triangular or trapezoidal.

6. The drum for the shot blasting apparatus of claim 1, wherein a starting point, which is the point where the projecting part for agitating is connected to the lower-half part, is arranged, in relation to the direction of the rotation of the drum, to be ahead of an end point, which is the point where the projecting part for agitating is connected to the middle part; and wherein an angle of twist formed between a line that connects the axis for rotation of the drum, a planar view and as seen from the direction of the axis for, rotation, with the starting point of the lower-half part of the drum and a line that connects the axis for rotation of the drum, in a planar view and as seen from the direction of the axis for rotation, with the end point of the middle part of the drum is from 50° to 120°.

7. The drum for the shot blasting apparatus of claim 6, wherein the length of the projecting part for agitating is less than the length of a generatrix of the middle part and the height of the projecting part for agitating is equal to or greater than ⅛ and equal to or less than ⅔ of the radius of the middle part of the drum, and wherein the cross-section of the shape formed by a surface for picking up and a surface for having the works slide down is triangular or trapezoidal, wherein the angle between the surface for picking up and the surface for having the works slide down is from 60° to 120°.

8. The drum for the shot blasting apparatus of claim 1, wherein further a plate-like-bar projection is connected to the inner periphery of the lower-half part of the drum and to that of the middle part of the drum, and wherein the plate-like-bar projection is provided in a way that it is inclined relative to the generatrix of a middle part.

9. A shot blasting apparatus, in addition to the drum of any of claims 1 and 2 to 8, further comprising a cabinet and a centrifugal injecting device, wherein the drum can turn around the axis for turning of the drum, which axis perpendicularly penetrates the axis for rotation of the drum and which is horizontally positioned, and thus the drum can turn around within the cabinet and can be stopped at a position for supplying the works to be treated, a position for treating the works, and a position for discharging the works that were treated;

the cabinet comprises a cover that can close an opening for supplying the works to be treated and discharging them when treated;

the cabinet further comprises a sealing-wall member on the side of the opening of the cabinet, consisting of a ceiling-wall, a floor-wall, and a plurality of side wails; and the cover is attached to the drum in such a way that the cover and the drum can turn around as one body.

10. The shot blasting apparatus of claim 9, wherein the cover consists of upper and lower arch-like wall members that can engage with the sealing-wall member, a string-like wall member that is connected to both anterior ends of the upper and lower arch-like wall members, and a plurality of side-wall members that connect the string-like wall member to the upper and lower arch-like wall members, respectively and wherein, further, sealing members, each with the shape of a lip, being lined in at least one row are disposed to seal gaps between the pair of upper and lower arch-like wall members of the cover and the sealing wall member, and to seal gaps between the plurality of side-wall members of the cover and the sealing wall member.

11. The shot blasting apparatus of claim 9, wherein a guide-flap for discharging the works that were treated is attached to an external cylinder that surrounds the drum.

* * * * *